US010500439B1

(12) United States Patent
Holman

(10) Patent No.: US 10,500,439 B1
(45) Date of Patent: Dec. 10, 2019

(54) EXERCISE SYSTEM

(71) Applicant: Aspen Integrative Kinetics, LLC, Aspen, CO (US)

(72) Inventor: Peter A. Holman, Aspen, CO (US)

(73) Assignee: Aspen Integrative Kinetics, LLC, Aspen, CO (US)

( * ) Notice: Subject to any disclaimer, the term of this patent is extended or adjusted under 35 U.S.C. 154(b) by 0 days.

(21) Appl. No.: 15/635,823

(22) Filed: Jun. 28, 2017

(51) Int. Cl.

| | |
|---|---|
| ***A63B 23/04*** | (2006.01) |
| ***A63B 21/04*** | (2006.01) |
| ***A63B 21/055*** | (2006.01) |
| ***A63B 21/062*** | (2006.01) |
| ***A63B 21/075*** | (2006.01) |
| ***A63B 21/00*** | (2006.01) |
| ***A63B 71/00*** | (2006.01) |

(52) U.S. Cl.
CPC ..... *A63B 23/0405* (2013.01); *A63B 21/0407* (2013.01); *A63B 21/0552* (2013.01); *A63B 21/063* (2015.10); *A63B 21/075* (2013.01); *A63B 21/154* (2013.01); *A63B 21/4035* (2015.10); *A63B 21/4047* (2015.10); *A63B 71/0054* (2013.01); *A63B 2210/50* (2013.01); *A63B 2225/093* (2013.01)

(58) Field of Classification Search
CPC ..... A63B 23/0405; A63B 21/154; A63B 71/0054; A63B 21/4047; A63B 21/4035; A63B 21/0407; A63B 21/075; A63B 21/063; A63B 21/0552; A63B 2210/50; A63B 2225/093; A63B 21/055; A63B 21/0615; A63B 23/03525; A63B 2208/0252; A63B 2208/0242; A63B 21/0421; A63B 21/068
See application file for complete search history.

(56) References Cited

U.S. PATENT DOCUMENTS

| | | | | |
|---|---|---|---|---|
| 5,147,267 A | | 9/1992 | Kunewalder | |
| 5,330,408 A | * | 7/1994 | Westmoreland, Jr. | A63B 23/12 482/133 |
| 5,411,458 A | * | 5/1995 | Giust | A63B 21/068 482/101 |
| 5,599,261 A | | 2/1997 | Easley et al. | |
| 5,628,715 A | * | 5/1997 | Simonson | A63B 21/0615 482/134 |
| 5,722,917 A | * | 3/1998 | Olschansky | A63B 21/0552 482/130 |
| 5,913,759 A | * | 6/1999 | Bostrom | A61H 1/0255 482/131 |
| 5,971,901 A | * | 10/1999 | Shaw | A61H 1/0218 482/142 |

(Continued)

*Primary Examiner* — Andrew S Lo
(74) *Attorney, Agent, or Firm* — Armstrong Teasdale LLP

(57) ABSTRACT

A support platform has a forward end and a rearward end with a mid-line dividing the support platform into a forward half and a rearward half. A foot platform has a first post coupling the foot platform to the support platform at a first height. A glutes platform is disposed at an angle and has a second post coupling the glutes platform to the support platform at a second height greater than the first height. A back platform is disposed at an angle and has a third post coupling the back platform to the support platform at a third height greater than the second height. A hinge pivotably couples the back platform to the third post. Resistance members are coupled to the back platform.

15 Claims, 8 Drawing Sheets

(56) References Cited

U.S. PATENT DOCUMENTS 6,220,994 B1 4/2001 Rich
6,299,569 B1 10/2001 Rich
6,398,699 B1 * 6/2002 Yang ..... A63B 22/14 482/142
6,468,188 B1 10/2002 Koenig
6,533,710 B2 3/2003 Lin et al.
6,605,024 B2 * 8/2003 Stearns ..... A63B 21/0615 482/136
6,692,418 B2 * 2/2004 Shahan ..... A63B 23/02 482/143
6,752,745 B1 * 6/2004 Davis ..... A63B 21/00 482/129
6,955,635 B2 10/2005 Chelekis
7,128,701 B1 * 10/2006 Ketcham ..... A63B 21/00047 482/142
7,367,928 B2 * 5/2008 Storch ..... A63B 21/00047 482/141
8,172,736 B2 * 5/2012 Contreras ..... A63B 21/00047 482/140
8,267,843 B2 9/2012 Dellino
D685,867 S * 7/2013 Mehlman ..... D21/687
9,119,984 B2 * 9/2015 Littell ..... A63B 26/00
9,630,055 B2 4/2017 Runyan et al.
9,669,255 B2 6/2017 Henniger et al.
9,737,750 B2 8/2017 Garcia Lopez et al.
9,782,622 B2 * 10/2017 Hornback ..... A63B 23/0482
9,861,850 B1 * 1/2018 Webber ..... A63B 21/00181
10,226,665 B2 3/2019 Kordecki
2002/0173412 A1 * 11/2002 Stearns ..... A63B 21/055 482/123
2002/0193216 A1 12/2002 Wu
2003/0022771 A1 * 1/2003 Stearns ..... A63B 21/0615 482/142
2003/0050155 A1 3/2003 Lat
2003/0060347 A1 * 3/2003 Tang ..... A63B 23/0222 482/141
2004/0053757 A1 * 3/2004 Chung ..... A63B 23/03525 482/140
2004/0058788 A1 * 3/2004 Thompson ..... A63B 21/068 482/95
2005/0143233 A1 * 6/2005 Shifferaw ..... A63B 21/023 482/140
2009/0029834 A1 * 1/2009 Isom ..... A63B 23/03525 482/96
2009/0176633 A1 7/2009 Dlugopolskiy
2009/0264265 A1 10/2009 Contreras
2010/0204027 A1 * 8/2010 Dauterive ..... A61H 1/024 482/145
2011/0263389 A1 10/2011 Burgassi et al.
2012/0202654 A1 8/2012 Contreras
2013/0023390 A1 1/2013 Ree
2015/0011370 A1 1/2015 Henniger
2015/0038304 A1 * 2/2015 Davenport ..... A63B 21/4035 482/123
2015/0367168 A1 12/2015 Henniger et al.
2016/0184629 A1 6/2016 Hornback et al.
2017/0056708 A1 * 3/2017 Kelly ..... A63B 21/4029
2017/0239124 A1 * 8/2017 Cunningham ... A63B 21/00054
2017/0239518 A1 8/2017 Porteros De Luz
2017/0304677 A1 10/2017 Clinton
2018/0001131 A1 1/2018 Nevarez, Jr. et al.
2018/0008857 A1 1/2018 Barber

* cited by examiner

FIG. 1
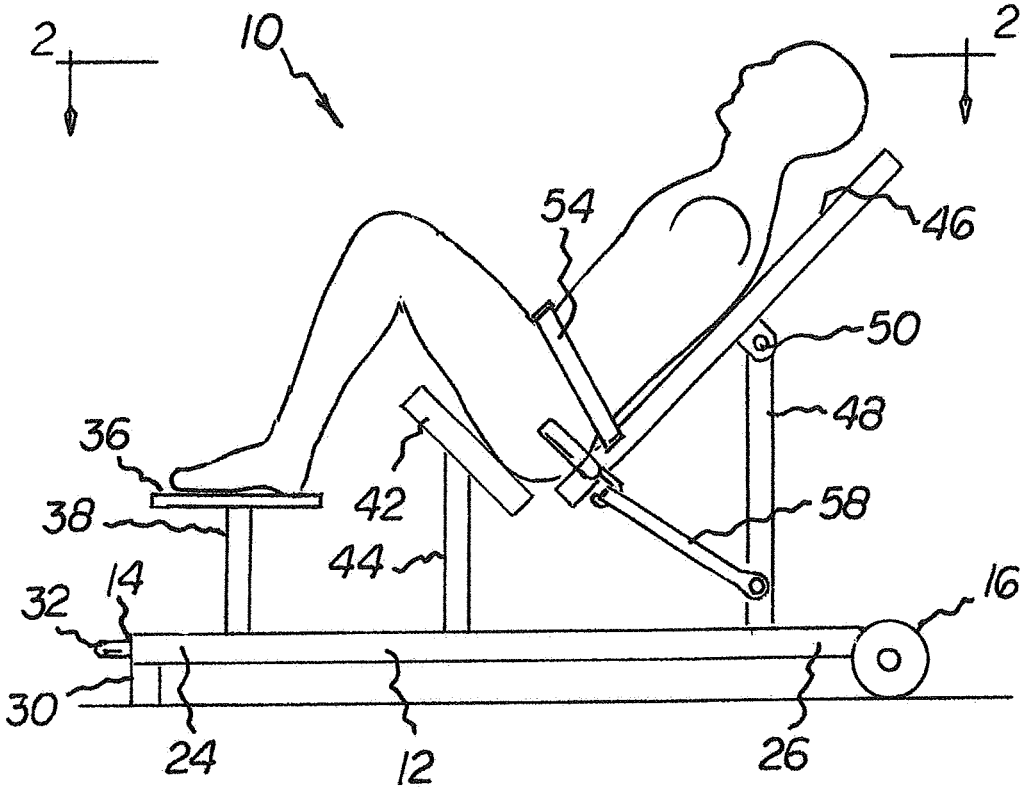
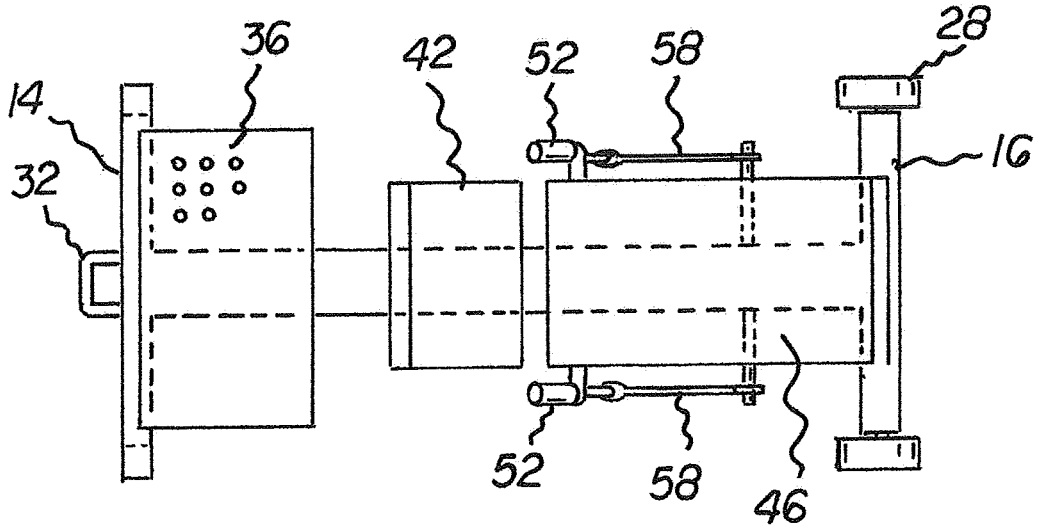
FIG. 2

FIG. 3
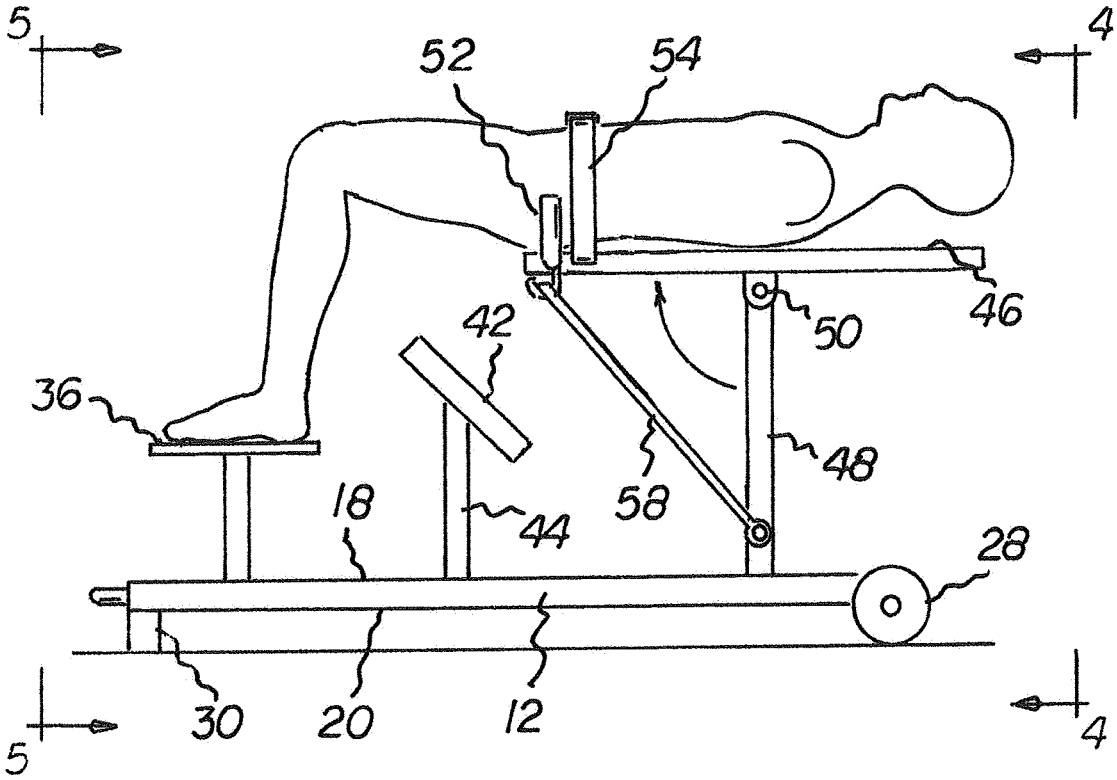
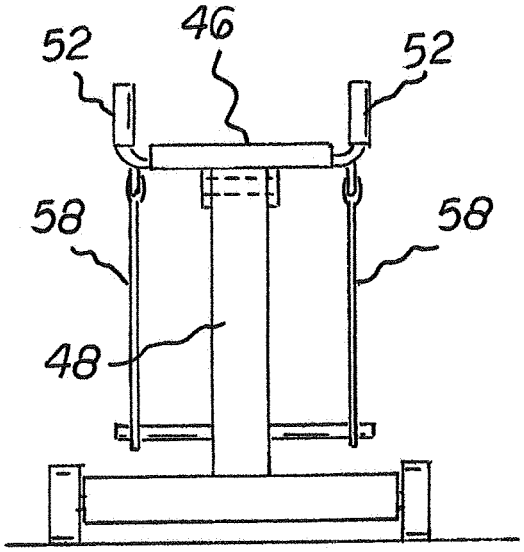
FIG. 4
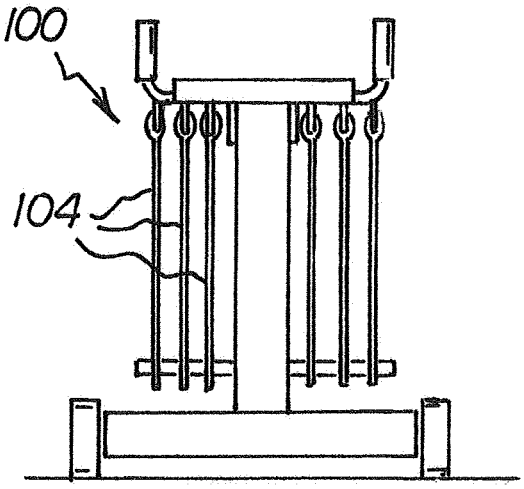
FIG. 4A

FIG. 5
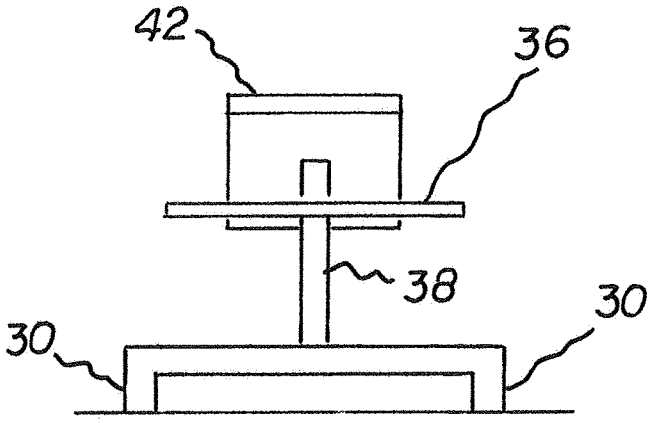
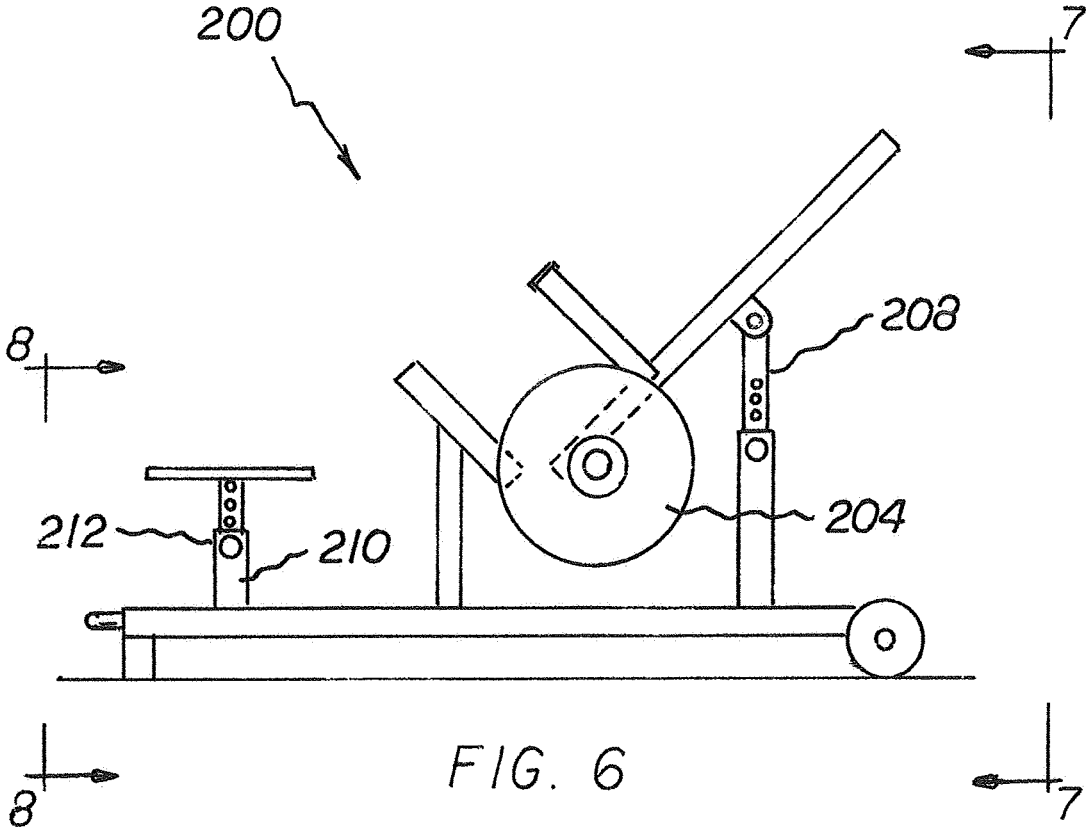
FIG. 6

FIG. 14
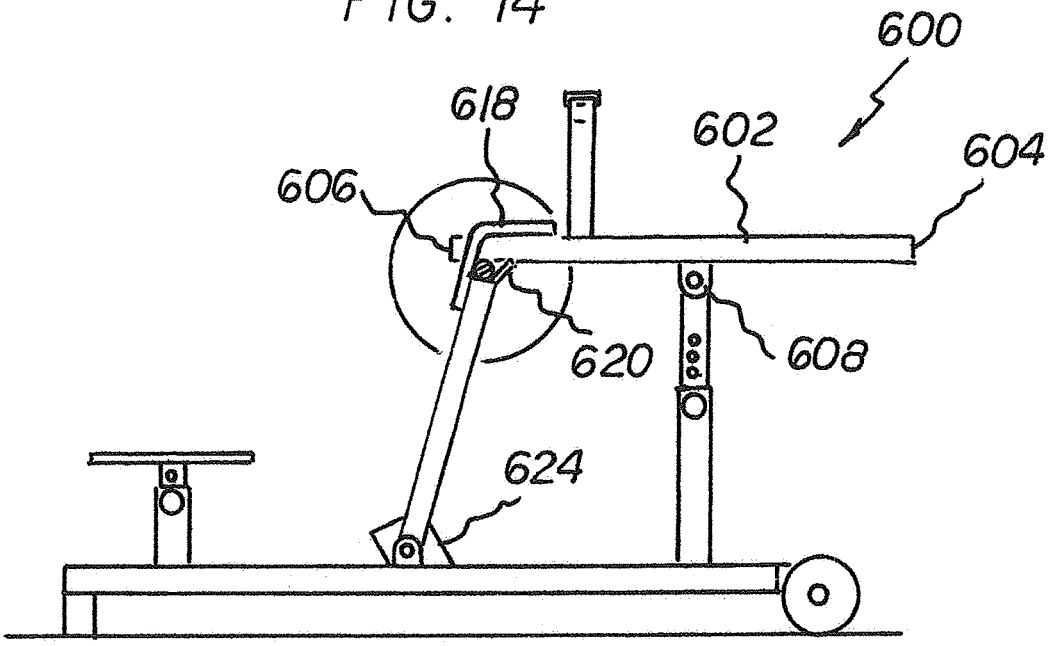
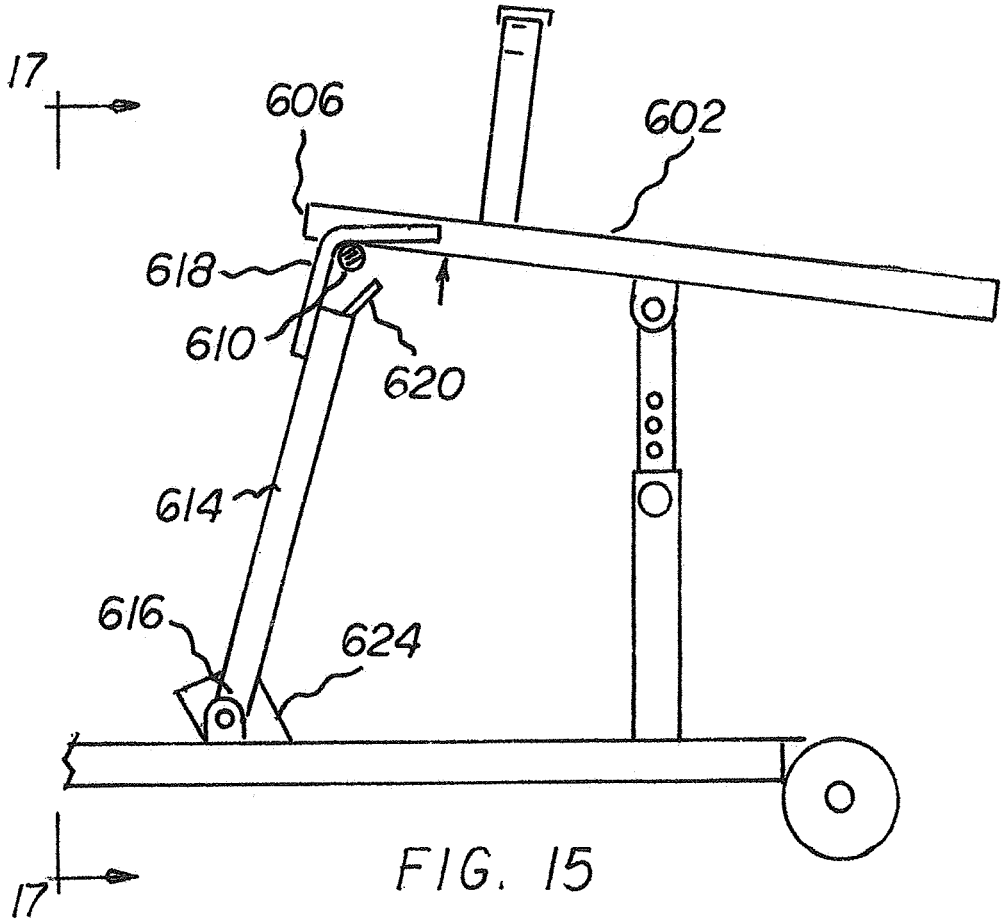
FIG. 15

EXERCISE SYSTEM

BACKGROUND OF THE INVENTION

Field of the Invention

The present invention relates to an exercise system and more particularly pertains to improving the strength and aesthetic appearance of glutes, hamstrings, and lower back muscles of a user, the improving being done in a safe, convenient, and economical manner.

Description of the Prior Art

The use of work out devices is known in the prior art. More specifically, work out devices previously devised and utilized for the purpose of facilitating exercise are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe an exercise system that allows improving the strength and aesthetic appearance of glutes, hamstrings, and lower back muscles of a user.

In this respect, the exercise system according to the present invention substantially departs from the conventional concepts and designs of the prior art, and in doing so provides an apparatus primarily developed for the purpose of improving the strength and aesthetic appearance of glutes, hamstrings, and lower back muscles of a user.

Therefore, it can be appreciated that there exists a continuing need for a new and improved exercise system which can be used for improving the strength and aesthetic appearance of glutes, hamstrings, and lower back muscles of a user. In this regard, the present invention in its various embodiments substantially fulfills this need.

SUMMARY OF THE INVENTION

In view of the disadvantages inherent in the known types of work out devices now present in the prior art, the present invention provides an improved exercise system. As such, the general purpose of the present invention, which will be described subsequently in greater detail, is to provide a new and improved exercise system and method which has all the advantages of the prior art and none of the disadvantages.

To attain this, from a broad perspective, the present invention essentially comprises a support platform which has a forward end and a rearward end with a mid-line dividing the support platform into a forward half and a rearward half. A foot platform has a first post coupling the foot platform to the support platform at a first height. A glutes platform is disposed at an angle and has a second post coupling the glutes platform to the support platform at a second height greater than the first height. A back platform is disposed at an angle and has a third post coupling the back platform to the support platform at a third height greater than the second height. A hinge pivotably couples the back platform to the third post. Resistance members are coupled to the back platform.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise system which has all of the advantages of the prior art work out devices and none of the disadvantages.

It is another object of the present invention to provide a new and improved exercise system which may be easily and efficiently manufactured and marketed.

It is a further object of the present invention to provide a new and improved exercise system which is of durable and reliable constructions.

An even further object of the present invention is to provide a new and improved exercise system which is susceptible of a low cost of manufacture with regard to both materials and labor, and which accordingly is then susceptible of low prices of sale to the consuming public, thereby making such exercise system economically available to the buying public.

Lastly, it is an object of the present invention to provide an exercise system for improving the strength and aesthetic appearance of glutes, hamstrings, and lower back muscles of a user.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is side elevational view of an exerciser system constructed in accordance with the principles of the present invention.

FIG. 2 is a plan view of the system taken along line 2-2 of FIG. 1.

FIG. 3 is a side elevational view similar to FIG. 1 but with the system in a different orientation.

FIG. 4 is a rear end elevational view taken along line 4-4 of FIG. 3.

FIG. 4A is a rear end elevational view taken along line 4-4 of FIG. 3 but with additional elastic bands for added resistance.

FIG. 5 is a front elevational view taken along line 5-5 of FIG. 3.

FIG. 6 is a side elevational view of an exerciser system constructed in accordance with an alternate embodiment of the invention.

FIG. 14 is a side elevational view of a final alternate embodiment of the invention featuring free weights and a safety catch.

FIG. 15 is a side elevational view similar to FIG. 14 but in a partially disengaged state.

The same reference numerals refer to the same parts throughout the various Figures.

DESCRIPTION OF THE PREFERRED EMBODIMENT

Figure 7:
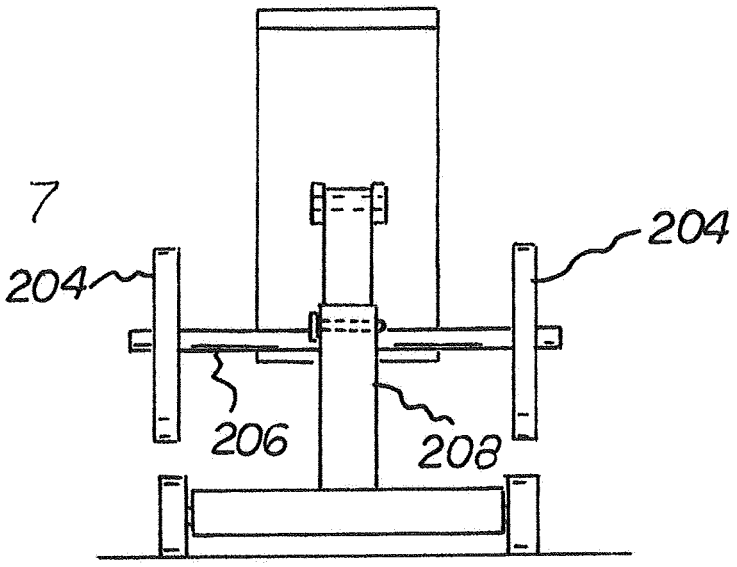
FIG. 7 is a rear elevational view taken along line 7-7 of FIG. 6.

With reference now to the drawings, and in particular to FIG. 1 thereof, the preferred embodiment of the new and improved exercise system embodying the principles and concepts of the present invention and generally designated by the reference numeral 10 will be described.

The present invention, the exercise system 10 is comprised of a plurality of components. Such components in their broadest context include a foot platform, a glute platform, and a pivotable back platform with resistance means. Such components are individually configured and correlated with respect to each other so as to attain the desired objective.

From a specific perspective, the invention of the present application is an exercise system 10 for improving the strength and aesthetic appearance of glutes, hamstrings, and lower back muscles of a user. The improving is done in a safe, convenient, and economical manner. The system includes a support platform 12 having front end 14 and a back end 16 and an upper surface 18 and lower surface 20. The support platform has a mid-line dividing the support platform into a front half 24 and a rear half 26. Laterally spaced wheels 28 depend from the platform adjacent to the rearward end. Laterally spaced legs 30 depend from the platform adjacent to the forward end. A handle 32 extends forwardly from the front end for repositioning the system.

A foot platform 36 is disposed horizontally above the support platform adjacent to the front end. A first post 38 fixedly couples the foot platform to the support platform at a first height.

A glute platform 42 is disposed at a negative angle of from 0 to 60 degrees above the front half support platform adjacent to the mid-line. A second post 44 fixedly couples the glute platform to the support platform at a second height greater than the first height.

A back platform 46 is disposed at a positive angle of from 0 to 90 degrees above the support platform adjacent to the rear end. A third post 48 has a hinge 50 pivotably coupling the glute platform to the support platform at a third height greater than the second height. The back platform has an upper end and a lower end. Handles 52 extend upwardly from the lower end of the back platform. A strap 54 is for securing a user to the back platform.

Elastic bands 58 couple the lower end of the back platform to any of a plurality of positions such as the third post adjacent to the support platform to provide resistance when a user, with feet on the foot platform and back on the back platform lifts his/her glutes from the glute platform and pivots the back platform by muscles of the glutes, hamstrings, and lower back muscles.

There are various alternate embodiments. In FIG. 4A, the resistance members include plural elastic bands 104 on each side of the back platform coupled to any convenient region of the system such as the third post adjacent to the support platform.

Figure 8:
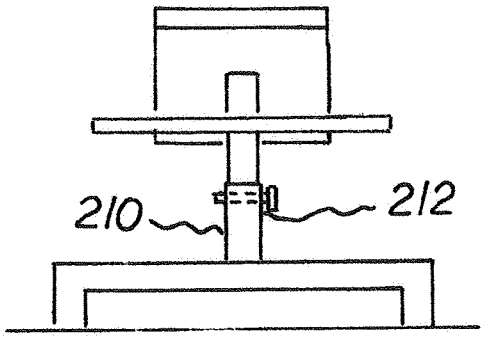
FIG. 8 is a front elevational view taken along line 8-8 of FIG. 6.
Figure 9:
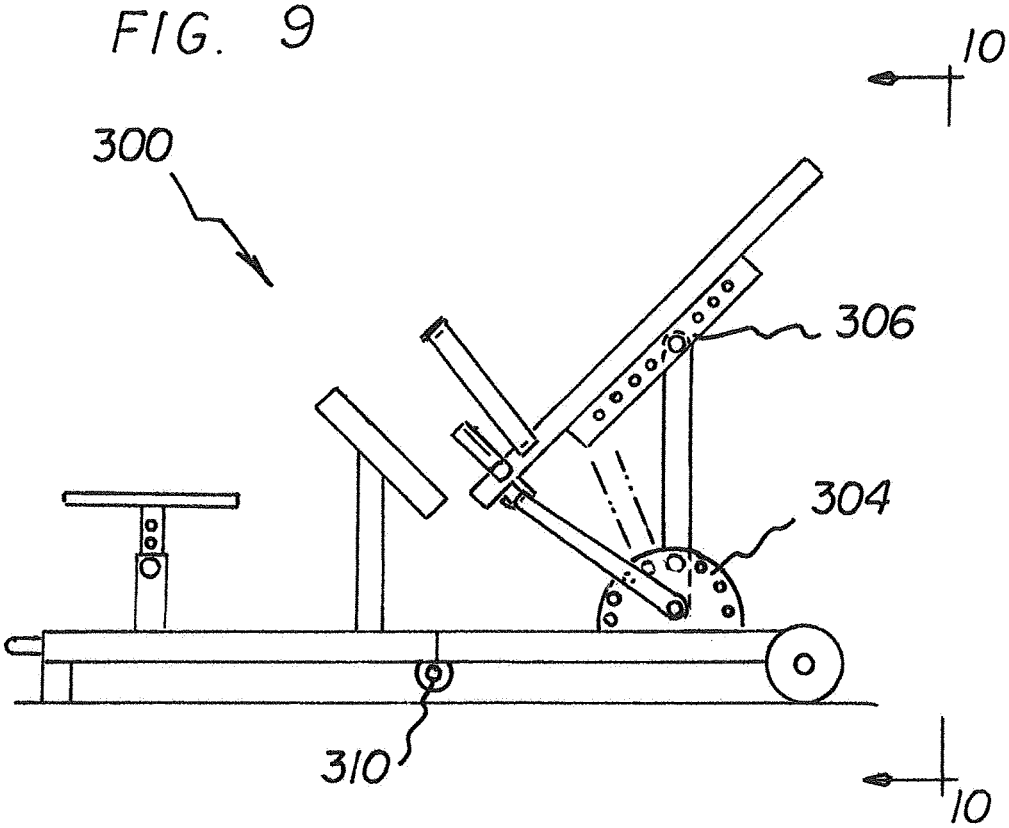
FIG. 9 is a side elevational view of an exerciser system constructed in accordance with a second alternate embodiment of the invention.
Figure 10:
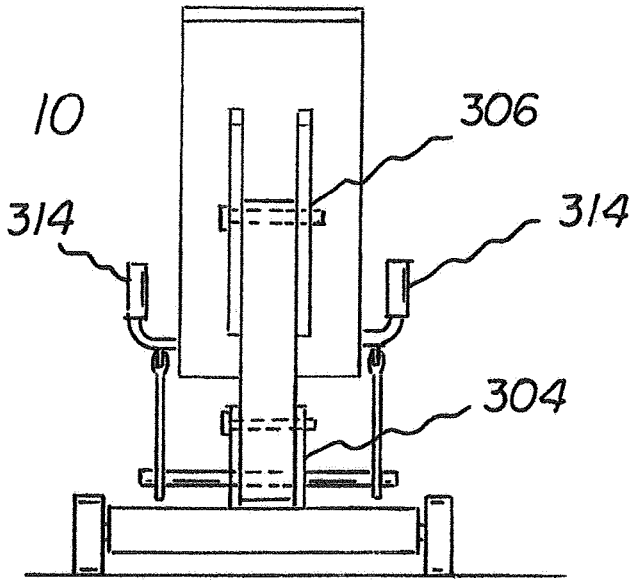
FIG. 10 is a rear elevational view taken along line 10-10 of FIG. 9.
Figure 11:
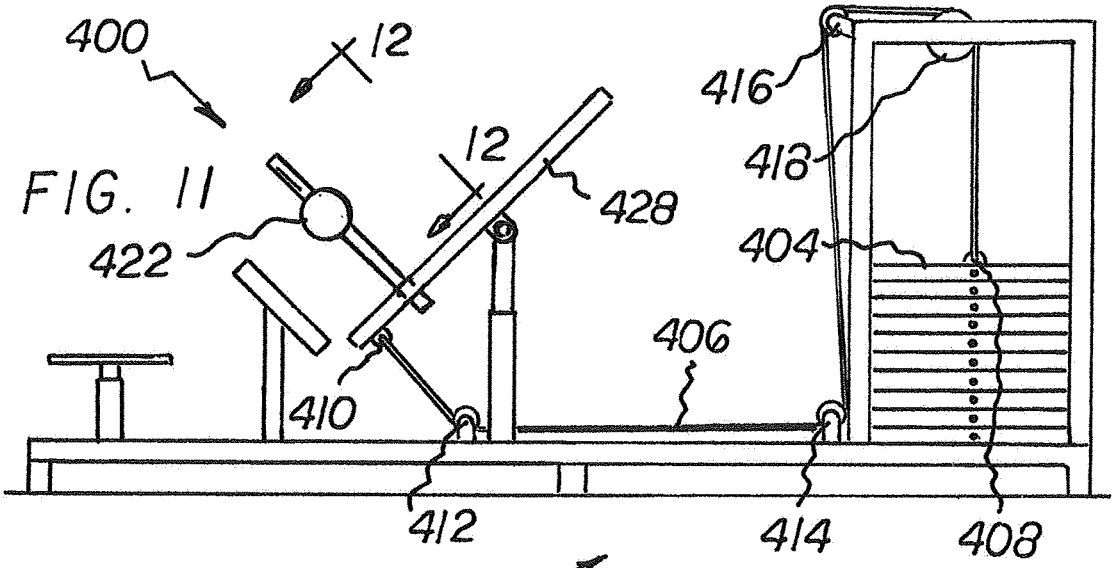
FIG. 11 is a side elevational view of another alternate embodiment of the invention featuring a weight stack.
Figure 12:
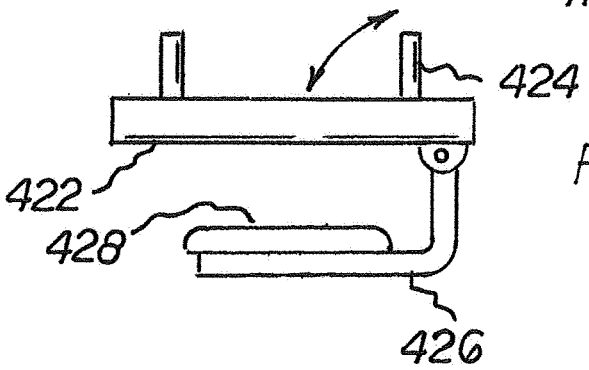
FIG. 12 is a plan view taken along line 12-12 of FIG. 11.

In the embodiment of FIGS. 6-8, the system 200 includes free weights 204 on bar 206 as the resistance members. Further, adjustment components 208 function to vary the height of the third post, and adjustment components 212 function to vary the height of first post 210.

The system 300 embodiment includes adjustment components 304 to vary the angular orientation of the third post with respect to the support platform. Further, adjustment components 306 function to vary the length and position of the back platform with respect to the third post. In addition, handles 314 are provided and are adapted to be grasped by a user during use. Lastly, a hinge 310 is adapted to fold the support platform during storage.

FIGS. 11-14 show a system 400 wherein the resistance member is a weight stack 404. Further included is a cord 406 having a forward end 408 attached to the weight stack and a rearward end 410 attached to the back platform adjacent to the glute platform. A plurality of pulleys 412, 414, 416, 418 direct the path of travel of the cord during use whereby pivoting of the back platform raises and lowers weights of the weight stack.

Such system 400 further includes a security bar 422 positioned to hold a user in place on the back platform during use. Hand grips 424 extend upwardly from the security bar. An L-shaped bracket 426 has a lower end attached to the back platform 428 and an upper end pivotably coupled to the security bar. This allows movement of the security bar between a lowered operative orientation and a raised inoperative orientation.

Figure 13:
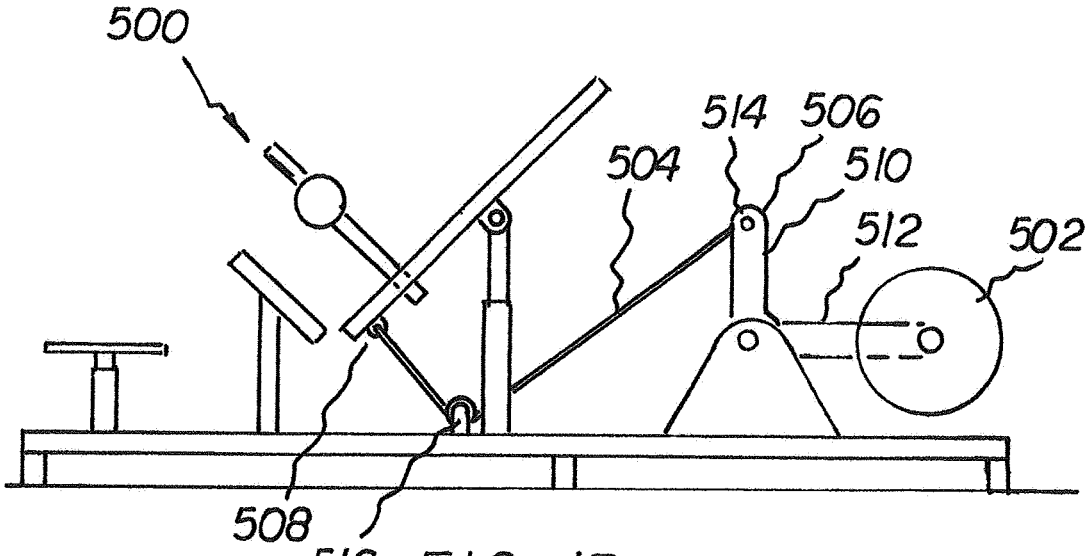
FIG. 13 is a side elevational view of another alternate embodiment of the invention featuring free weights with levers and pulleys.

In system 500, as seen in FIG. 13, the resistance member is free weights 502 and further includes a cord 504 or bar linkage having a forward end 506 adjacent to the free weight and a rearward end 508 attached to the back platform adjacent to the glute platform. A plurality of levers 510, 512 and a plurality of pulleys 514, 516 direct a path of travel of the cord and a raising and lowering of the free weights in response to pivoting of the back platform.

Reference is now made to FIGS. 14-17. An exercise system 600 includes a support platform having a forward end and a rearward. The support platform has a mid-line dividing the support platform into a forward section and a rearward section.

A foot platform has a first post coupling the foot platform to the support platform. Such coupling is at a first height.

A back platform 602 is disposed at an angle. A second post couples the back platform to the support platform. Such coupling is at a second height greater than the first height. The back platform has a forward end 604 and a rearward end 606.

In addition, a hinge 608 is pivotably coupled between the back platform and the second post.

Further included is a tube 610 coupled to the back platform with free ends extending laterally from the back platform. The free ends are adapted to receive and retain free weights.

Further included is a safety catch 614 in an H-shaped configuration with generally vertical legs and a horizontal leg there between. The generally vertical legs have lower ends 616 pivotably coupled to the support platform. The safety catch have upper ends. The upper ends each has an L-shaped bracket 618 rearwardly, the upper ends each having a generally vertical bracket 620 forwardly. A space is formed for passage of the tube between each L-shaped bracket and an associated generally vertical bracket. In this manner, the safety catch will hold the back platform horizontal until the user is on the back platform and lifts the rearward end of the back platform thus disengaging the safety catch which can then be moved rearward allowing the back platform to pivot during operation and use.

Figure 16:
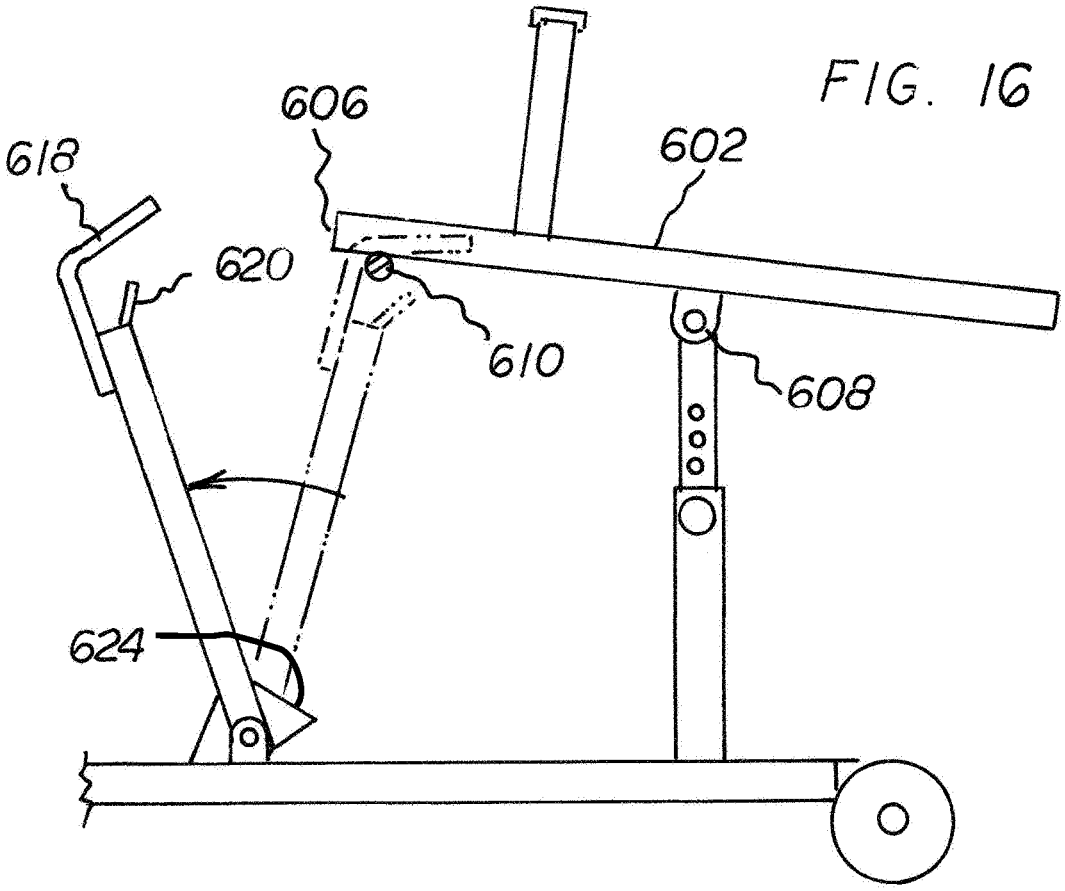
FIG. 16 is a side elevational view similar to FIG. 15 but in a fully disengaged state.
Figure 17:
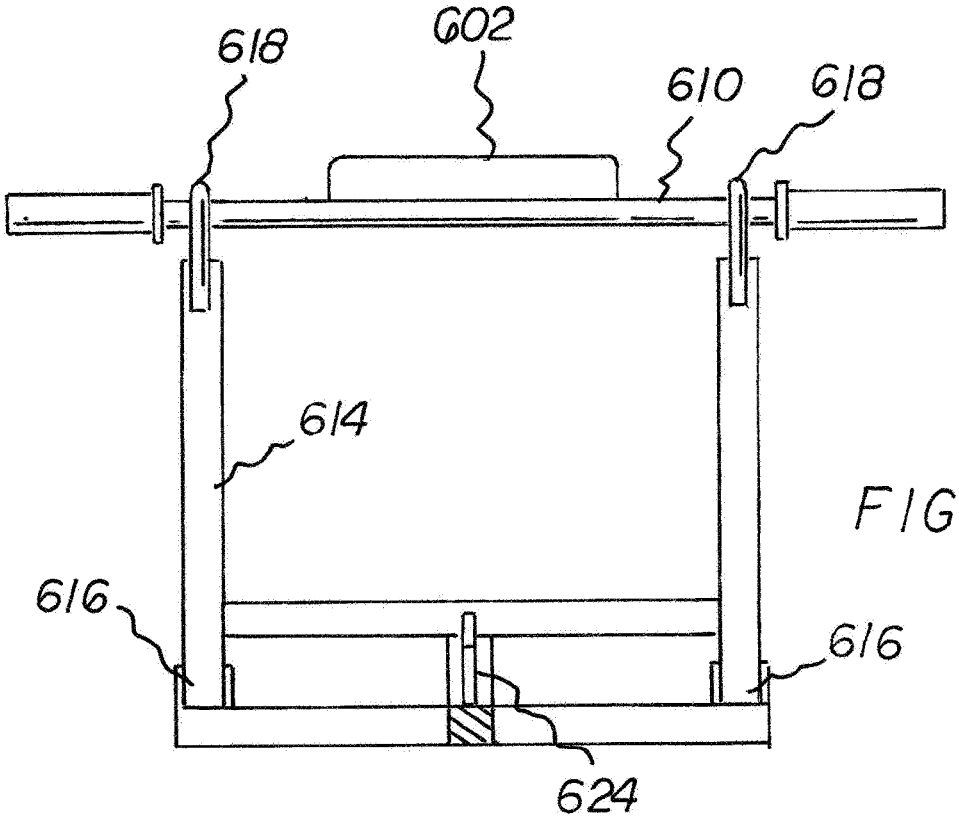
FIG. 17 is a front elevational; view taken along line 17-17 of FIG. 15.

FIGS. 14-16 illustrate the operation of the safety, catch which allows a user to lie safely on the back platform when coupled by the seat belt. Thereafter, the user releases the safety catch to allow a full range of motion of the back platform and complete exercise as well as the safely storing of the weights.

Lastly, a wedge 624 is secured to and rotatable with the cross leg to limit the rotational movement of the safety catch during use due to contact of the wedge with the support platform.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise system comprising:

a support platform;

a back platform pivotably coupled to the support platform by a post;

a waist belt operatively coupled to the back platform to hold a user in place on the back platform during use;

a tube coupled to the back platform with free ends extending laterally from the back platform, the free ends adapted to receive and retain free weights; and a safety catch securing the back platform in a first, fixed orientation prior to the user beginning exercising, wherein the safety catch comprises a pair of spaced apart vertical legs and a cross leg extending therebetween, and wherein the safety catch is selectively releasable from the back platform by a user lying on the back platform such that the back platform is movable from the first, fixed orientation.

2. The system as set forth in claim 1 further comprising a foot platform coupled to a forward end of the support platform, wherein the back platform is coupled to a rearward end of the support platform.

3. The system as set forth in claim 2, wherein the foot platform is coupled at a first height above the support platform, and wherein the back platform is coupled at a second height above the support platform greater than the first height.

4. The system as set forth in claim 1, wherein a height of the post is selectively adjustable.

5. The system as set forth in claim 1, wherein the system does not include a glutes platform.

6. The system as set forth in claim 1 further comprising a bracket coupled to each of the vertical legs for retaining the tube while the back platform is in the first, fixed orientation.

7. An exercise system comprising:

a support platform;

a back platform having a one piece construction for supporting a user while exercising;

at least one resistance member coupled to the back platform;

a post coupling the back platform to the support platform;

a hinge pivotably coupling the back platform to the post;

a waist belt operatively coupled to the back platform to hold a user in place on the back platform during use; and a safety catch securing the back platform in a first, fixed orientation prior to the user beginning exercising, wherein the safety catch comprises a pair of spaced apart vertical legs and a cross leg extending therebetween, and wherein the safety catch is selectively releasable from the back platform by a user lying on the back platform such that the back platform is movable from the first, fixed orientation.

8. The system as set forth in claim 7 further comprising a foot platform coupled to a forward end of the support platform, wherein the back platform is coupled to a rearward end of the support platform.

9. The system as set forth in claim 8, wherein the foot platform is coupled at a first height above the support platform, and wherein the back platform is coupled at a second height above the support platform greater than the first height.

10. The system as set forth in claim 7 wherein the at least one resistance member comprises free weights.

11. The system as set forth in claim 7 wherein a height of the post is selectively adjustable.

12. The system as set forth in claim 7, wherein the system does not include a glutes platform.

13. The system as set forth in claim 7 further comprising a tube coupled to the back platform with free ends extending laterally from the back platform, the free ends adapted to receive and retain free weights.

14. The system as set forth in claim 7 further comprising a bracket coupled to each of the vertical legs for supporting a tube coupled to the back platform while the back platform is in the first, fixed orientation.

15. An exercise system comprising:

a support platform having a forward end and a rearward end, the support platform having a mid-line dividing the support platform into a forward section and a rearward section;

a foot platform, a first post coupling the foot platform to the support platform at a first height, a back platform disposed at an angle, a second post coupling the back platform to the support platform at a second height greater than the first height, the back platform having a forward end and a rearward end;

a hinge pivotably coupling the back platform to the second post;

a tube coupled to the back platform with free ends extending laterally from the back platform, the free ends adapted to receive and retain free weights;

a safety catch having an H-shaped configuration with generally vertical legs and a horizontal cross leg therebetween, the generally vertical legs having lower ends pivotably coupled to the support platform, the safety catch having upper ends, the upper ends each having an L-shaped bracket rearwardly, the upper ends each having a generally vertical bracket forwardly, a space for passage of the tube between each L-shaped bracket and an associated generally vertical bracket whereby the safety catch will hold the back platform horizontal until a user is on the back platform and lifts the lower end of the back platform to disengage and move the safety catch rearwardly where upon the back platform may pivot during operation and use; and a wedge secured to and rotatable with the cross leg to limit rotational movement of the safety catch during use.

* * * * *